US006649583B2

(12) United States Patent
Todini

(10) Patent No.: US 6,649,583 B2
(45) **Date of Patent: *Nov. 18, 2003**

(54) BLEACHING COMPOSITIONS

(75) Inventor: Oreste Todini, Rome (IT)

(73) Assignee: Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/301,169

(22) Filed: Nov. 21, 2002

(65) Prior Publication Data

US 2003/0109404 A1 Jun. 12, 2003

Related U.S. Application Data

(63) Continuation of application No. 09/786,076, filed as application No. PCT/US99/20127 on Sep. 1, 1999, now Pat. No. 6,506,718.

(30) Foreign Application Priority Data

Sep. 1, 1998 (EP) ..... 98870185

(51) Int. Cl.[7] ..... C11D 3/395
(52) U.S. Cl. ..... 510/380; 510/358; 510/360
(58) Field of Search ..... 510/302, 380, 510/358, 360

(56) References Cited

U.S. PATENT DOCUMENTS

| | | | | |
|---|---|---|---|---|
| 3,560,389 A | | 2/1971 | Hunting | |
| 3,929,661 A | | 12/1975 | Nakagawa et al. | |
| 4,388,204 A | * | 6/1983 | Dimond et al. | 252/98 |
| 4,588,514 A | | 5/1986 | Jones et al. | |
| 4,671,894 A | | 6/1987 | Lamb et al. | |
| 5,034,150 A | | 7/1991 | Smith | |
| 5,279,758 A | | 1/1994 | Choy | |
| 5,364,553 A | | 11/1994 | Cao | |
| 6,506,718 B1 | * | 1/2003 | Todini | 510/380 |

FOREIGN PATENT DOCUMENTS

| | | |
|---|---|---|
| EP | 0 243 685 A2 | 11/1987 |
| EP | 0 340 371 A2 | 11/1989 |
| EP | 0 903 403 A1 | 3/1999 |
| EP | 0 931 829 A1 | 7/1999 |
| JP | 10-204495 A | 8/1998 |

* cited by examiner

*Primary Examiner*—Yogendra N. Gupta
*Assistant Examiner*—John M Petruncio
(74) *Attorney, Agent, or Firm*—James F. McBride; Kim W. Zerby; Steve W. Miller

(57) ABSTRACT

The present invention relates to liquid hypohalite bleach-containing compositions which comprise an alkyl ethoxy sulphate having a low number of moles of ethoxy groups.

6 Claims, No Drawings

BLEACHING COMPOSITIONS

CROSS REFERENCE TO RELATED APPLICATIONS

This application is a continuation under 35 U.S.C. §120 of U.S. application Ser. No. 09/786,076 filed on Feb. 28, 2001 now U.S. Pat. No. 6,506,718, which is a national stage entry under 35 U.S.C. §371 of PCT/US99/20127, filed Sep. 1, 1999, which in turn claims priority to EP 98870185.0 filed Sep. 1, 1998.

FIELD OF THE INVENTION

The present invention relates to bleaching compositions, in particular to hypochlorite bleaching compositions, suitable for use in various laundry applications including hand and machine laundry methods.

BACKGROUND OF THE INVENTION

Bleaching compositions are well-known in the art. Amongst the different bleaching compositions available, those relying on bleaching by hypohalite bleaches such as hypochlorite are often preferred, mainly for performance reasons, especially at lower temperature.

However hypohalite bleaches are known to be aggressive bleaching agents that may potentially facilitate the decomposition of other components of a bleaching composition. The Applicant has found that this is particularly true of alkyl ethoxy sulphates which are often preferred anionic surfactants of hypohalite bleach-containing compositions.

EP 243 685 and EP 181 212 both describe compositions comprising alkyl ethoxy sulphate having an average of from 1 to 3 and less than 6 moles of ethoxy groups respectively. However neither document describe compositions comprising hypohalite bleach.

EP 580 245 describes a composition comprising alky ethoxy sulphate having from 1 to 11 moles of ethoxy groups and optionally on oxygen-releasing bleach.

Hence, the object of the present invention is to provide a hypohalite-containing composition comprising an alkyl ethoxy sulphate that is stable and provides improved soil removal benefits.

SUMMARY OF THE INVENTION

The present invention provides a liquid bleaching composition comprising a hypohalite bleach and an alkyl ethoxy sulphate having an average of 2 or less moles of ethoxy groups.

In another aspect of the present invention there is provided the use of said composition to provide improved stain removal and/or fabric whiteness and storage stability.

DETAILED DESCRIPTION OF THE INVENTION

Liquid Bleaching Compositions

The compositions according to the present invention are in liquid form. Preferably, the compositions of the invention are in liquid aqueous form. More preferably, they comprise water in an amount of from 60% to 98% by weight, more preferably of from 80% to 97% and most preferably of from 85% to 97% by weight of the total aqueous liquid bleaching composition.

Hypohalite Bleach

An essential component of the invention is a hypohalite bleach. Hypohalite bleaches may be provided by a variety of sources, including bleaches that are oxidative bleaches and subsequently lead to the formation of positive halide ions as well as bleaches that are organic based sources of halides such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

The preferred hypohalite bleaches among the above described, are the alkali metal and/or alkaline earth metal hypochlorites selected from the group consisting of sodium, potassium, magnesium, lithium and calcium hypochlorites, and mixtures thereof, more preferably alkali metal sodium hypochlorite.

Preferably, the liquid compositions according to the present invention comprise said hypohalite bleach such that the content of active halide in the composition is from 0.1% to 20% by weight, more preferably from 0.25% to 8% by weight, most preferably from 0.5% to 6% by weight of the composition.

Alkyl Ethoxy Sulphate

The second essential component of the composition of the present invention is an alky ethoxy sulphate. The alkyl ethoxy sulphate is preferably a water-soluble salt or acid of the formula $RO(A)_mSO_3M$ wherein R is an unsubstituted $C_6$–$C_{30}$ linear or branched alkyl group, preferably a $C_{10}$–$C_{20}$ linear or branched alkyl, more preferably $C_{12}$–$C_{18}$, most preferably $C_{12}$–$C_{14}$ linear or branched alkyl group, A is an ethoxy unit, m is 2 or less, more preferably between 0.05 and 2, most preferably 0.05 to less than 1 mole, and M is H or a cation which can be, for example, a metal cation, preferably an alkali or alkaline earth metal, (e.g., sodium, potassium, lithium, calcium, magnesium, etc.), ammonium or substituted ammonium cation. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Preferred examples of alkyl ethoxy sulphates are selected from the group consisting of $C_{12}$–$C_{14}$ ethoxy sulfate. The most preferred alkyl ethoxy sulfate is the sodium salt of lauryl ethoxy (1) sulfate or $C_{12}H_{25}OCH_2CH_2OSO_3Na$.

The compositions of the present invention provide improved soil removal fabric whiteness and storage stability versus identical compositions, not comprising an alkyl ethoxy sulfate having 2 or less moles of ethoxy groups.

It is believed that the improved soil removal is achieved due to the higher hydrophobicity of the surfactant and thus the higher affinity for soils. Additionally, the lower the ethoxylation degree, the more weight effective the surfactant, i.e., the higher the molar concentration for a given surfactant level in the finished product. The increased affinity for and subsequent solubilisation and removal of soils is perceived as an improvement in fabric whiteness by consumers.

Furthermore, the compositions of the present invention exhibit improved stability versus identical compositions comprising the alkyl ethoxy sulfate with a higher degree of ethoxylation, i.e. greater than 2. It is believed that this stability benefit is achieved because, as the Applicant has found, it is the ethoxy groups of alkyl ethoxy sulfate that are sensitive to hypohalite bleach. Thus, the Applicant has found that by lowering the number of moles of ethoxy groups of 2 or less, the stability of the surfactant and the composition can be improved without adversely affecting solubility of the surfactant.

Viscosity

Typically such compositions according to the present invention have a viscosity between 0 cps and 2000 cps, preferably between 50 cps and 1100 cps. Has a preferred embodiment of the present invention, the viscosity of the composition can be further modified by addition of a co-surfactant. Where present the ratio of alkyl ethoxy sulfate and a co-surfactant will determine the actual viscosity. Viscosity is measured with a rheometer like carri-med CSL2-100® at the following viscosity parameters : angle: 1°58, gap: 60, diameter : 4.0 cm, iner: 63.60 at a temperature of 25° C. and a shear rate of 30 1/sec.

Optional Components

In addition to the essential components described above, the bleaching composition may also comprise one or more optional components. Optional components may be selected from brightener, radical scavenger, chelating agent, pH buffering agent, co-surfactant and polymers.

Brightener

An optional component of the invention is a brightener. Any brighteners known to those skilled in the art may be used herein including both hydrophobic and hydrophilic brighteners and mixtures thereof.

Brighteners are compounds which have the ability to fluorescence by absorbing ultraviolet wave-lengths of light and re-emitting visible light. Brighteners, also referred to as fluorescent whitening agents (FWA), have been extensively described in the art, see for instance EP-A-0 265 041, EP-A-0 322 564, EP-A-0 317 979 or "Fluorescent whitening agents" by A. K. Sarkar, published by MERROW, especially page 71–72.

Commercial optical brighteners which may be useful in the present invention can be classified into subgroups, which include, but are not necessarily limited to, derivatives of stilbene, pyrazoline, coumarin, carboxylic acid, methinecyanine, dibenzothiophene-5,5-dioxide, azole, 5- and 6-membered-ring heterocycle, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof. Particularly preferred brighteners for use herein are the derivatives of stilbene and mixtures thereof.

Examples of optical brighteners which are useful in the present compositions are those identified in U.S. Pat. No. 4,790,856. These brighteners include the PHORWHITE® series of brighteners from Verona. Other brighteners disclosed in this reference include: Tinopal-UNPA®, Tinopal CBS® and Tinopal 5BM® available from Ciba-Geigy; Artic White CC® and Artic White CWD®; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins.

The Radical Scavenger

An other optional component of the invention is a radical scavenger. Naturally, for the purpose of the present invention, the radical scavengers have to be stable to the hypohalite bleach.

Suitable radical scavengers for use herein include aromatic radical scavengers comprising an unsaturated ring system of from 3 to 20 carbon atoms, preferably of from 3 to 18 and more preferably of from 5 to 14 and having a double bond set comprising a total of 4n+2 electrons, wherein n is an integer of from 0 to 4, preferably of from 1 to 3. Indeed said aromatic radical scavengers include benzene derivatives, naphthalene derivatives, annulene derivatives, cyclopentadiene derivatives, cyclopropene derivatives and the like, especially aryl carboxylates and/or aryl sulfonates.

Particularly suitable radical scavengers (aryl carboxylates, aryl sulphonate and derivatives thereof) for use in the present invention have one of the following formulas:

a)

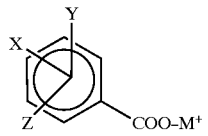

(b)

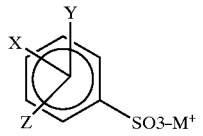

c)

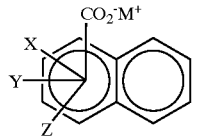

d)

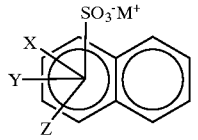

wherein each X, Y, and Z are —H, —COO—$M^+$, —Cl, —Br, —$SO_3$—$M^+$, —$NO_2$, —$OCH_3$, or a $C_1$ to $C_{10}$ primary and secondary alkyl groups and M is H or an alkali metal, or mixtures thereof. Examples of these components include pyromellitic acid, i.e. where X, Y and Z are —COO—$H^+$; hemimellitic acid, trimellitic acid, i.e. where X and Y are —COO—$H^+$ and Z is H. Preferred to be used in the present invention as radical scavengers are phthalic acid; sulfophthalic acid; other mono-substituted phthalic acids; di-substituted benzoic acids; alkyl-, chloro-, bromo-, sulfo-, nitro- and alkoxy-benzoic acids, i.e. where Y and Z are —H and X is a $C_1$ to $C_{10}$ primary and secondary alkyl groups, —Cl, —Br, —$SO_3$—$H^+$, —$NO_2$, and —$OCH_3$ respectively and substituted sulfonic acids. Preferred examples of the radical scavengers useful in the present invention are benzoic acid, methoxy benzoic acid, 3-nitrobenzoic acid, 4-toluene sulfonic acid, 2 n-octyl benzoic acid, 2 n-octyl sulfonic acid, anisic acid or salts thereof or mixtures thereof. Highly preferred examples of radical scavengers herein are benzoic acid and/or methoxy benzoic acid and/or 3-nitro benzoic acid.

All the radical scavengers described above are the acidic form of the species, i.e. M is H. It is intended that the present invention also covers the salt derivatives of these species, i.e. M is an alkali metal, preferably sodium or potassium. In fact, since the pH of the compositions of the present invention is in the alkaline range, the radical scavengers of the present invention exist primarily as the ionized salt in the aqueous composition herein. The anhydrous derivatives of certain species described herein above can also be used in the present invention, e.g. pyromellitic dianhydride, phthalic anhydride, sulphthalic anhydride and the like.

Where present the radical scavenger may be present at a level of from 0.001% to 10% by weight of the total composition of a radical scavenger, preferably from 0.01% to 8%, more preferably from 0.1% to 6% and most preferably from 0.2% to 4%.

Chelating Agents

In the compositions of the present invention, a chelating agent is an optional but preferred component. Naturally, for the purpose of the present invention, the chelating agents have to be stable to the hypohalite bleach.

Suitable chelating agents may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof.

Chelating agents may be desired in the compositions of the present invention, preferably phosphate chelating agents like phytic acid, as they further contribute to the benefit delivered by the radical scavengers herein by further improving the stability of the brighteners, thus delivering effective whiteness performance in any laundry application upon ageing of the compositions, i.e. after prolonged periods of storage. Thus, in its broadest aspect the present invention encompasses the use, in a hypohalite bleaching composition comprising a brightener, of a chelating agent, for improved brightener stability in said composition as well as the use, in a hypohalite bleaching composition comprising a brightener, of a chelating agent, for effective whiteness performance upon ageing of the composition.

The presence of chelating agents may also contribute to reduce tensile strength loss of fabrics and/or colour damage, especially in a laundry pretreatment application. Indeed, the chelating agents inactivate the metal ions present on the surface of the fabrics and/or in the cleaning compositions (neat or diluted) that otherwise would contribute to the radical decomposition of the hypohalite bleach.

Fabric safety may be evaluated by different test methods including the degree of polymerisation test method according to UNI (Ente Nazionale Italiano di Unificazione) official method UNI 8282-Determinazione della viscosita intrinseca in soluzione di cuprietilendiammina (CED).

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Suitable phosphate chelating agents are as following: Phosphonic acid can be condensed in the reaction:

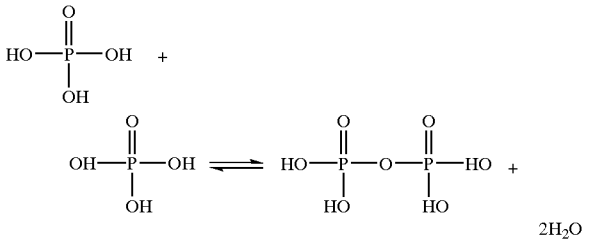

The reaction can be repeated with any of the reactive OH groups, and phosphate ingredients are obtained which can be linear or branched polyphosphates of structure:

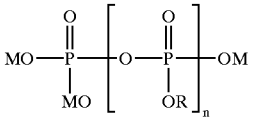

when R is M or

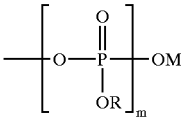

when M is a counterion, preferably alkali metal;

when O≦n+m<500 (if n+m=0 then the compound is phosphonic acid)

cyclic polyphosphates (also referred to as metaphosphates), of structure:

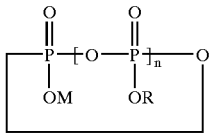

when R is M or

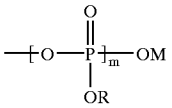

if R is

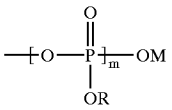

the phosphate compound contains both cycles and branched chain, and can be referred to as an ultraphosphate.)

where M is a counterion, preferably an alkali metal where O≦n+m<500

All such phosphate ingredients are suitable for use herein, and preferred are linear phosphate ingredients (i.e. R is M) where n is 1 (pyrophosphate) and n is 2 (tripolyphosphate (STPP)), most preferably where n is 2. The most commonly available form of these phosphate is where M is Sodium.

Phytic acid, which is particularly suitable for use herein, is a hexa-phosphoric acid that occurs naturally in the seeds of many cereal grains, generally in the form of the insoluble calcium-magnesium salt. It may also be derived from corn steep liquor. Commercial grade phytic acid is commercially available from J. T. Baker Co., e.g. as a 40% aqueous solution. It is intended that the present invention covers the acidic form of phytic acid as well as alkali metal salt derivatives thereof, particularly sodium or potassium salts thereof. Sodium phytate is available from Jonas Chemical Co (Brooklyn, N.Y.). In fact since the typical pH of the compositions of the present invention are in the alkaline pH range, the phytic acid component exists primarily as the ionized salt in the liquid compositions herein even if it is added in its acidic form. Mixtures of such salts of phytic acid are also covered.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Particularly preferred chelating agents for use herein are phosphate chelating agents like sodium pyrophosphate, sodium tripolyphosphate, phytic acid, and mixtures thereof.

Typically, the compositions according to the present invention comprise up to 10% by weight of the total composition of a chelating agent, or mixtures thereof, preferably from 0.01% to 5% by weight, more preferably from 0.05% to 2% and most preferably from 0.1% to 1.5%.

pH

The liquid compositions of the present invention have a pH of preferably from 8 to 14, more preferably from 9 to 14, most preferably from 10 to 13. When diluted into 1 to 500 times its weight of water, the pH of the diluted solution is preferably from 7.5 to 13, more preferably from 8 to 12, most preferably from 8.5 to 11.5. It is in this alkaline range that the optimum stability and performance of the hypohalite, as well as fabric whiteness and/or safety are obtained. The pH range is suitably provided by the hypohalite bleach mentioned hereinbefore and optionally the pH buffering component when present, which are alkalis. However, in addition to these components, a strong source of alkalinity may also optionally be used.

Suitable sources of alkalinity are the caustic alkalis such as sodium hydroxide, potassium hydroxide and/or lithium hydroxide, and/or the alkali metal oxides such as sodium and/or potassium oxide. A preferred strong source of alkalinity is a caustic alkali, more preferably sodium hydroxide and/or potassium hydroxide. Typical levels of such caustic alkalis, when present, are of from 0.1% to 1.5% by weight, preferably from 0.5% to 1.5% by weight of the composition.

Optional pH Buffering Components

In the compositions of the present invention, the presence of a pH buffering component is not compulsory, but is highly preferred.

The pH buffering component ensures that the pH of the composition and diluted solution are buffered to pH range described above.

Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. The preferred alkali metal salts for use herein are sodium and potassium.

Suitable boron salts or mixtures thereof for use herein include alkali metal salts of borates and alkyl borates and mixtures thereof. Examples of boron salts include boric acid, alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Particularly preferred boron salts herein are the alkali metal salts of metaborate, such as sodium metaborate, potassium metaborate, and the alkali metal salts of borate, such as sodium borate, or mixtures thereof. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g. calcium carbonate resulting in an amount of up to 0.4% by weight of by-product within the hypohalite composition. However, at such amount, the by-product will not have the buffering action defined above.

Liquid bleaching compositions herein will preferably contain an amount of pH buffering component of from 0.5% to 9% by weight, more preferably from 0.5% to 5% by weight, and most preferably in an amount of from 0.6% to 3% by weight of the composition.

The composition according to the invention may comprise other optional components such as bleach-stable surfactants, organic or inorganic alkalis, builders, thickening agents, polymers, pigments, dyes, solvents, perfumes, and mixtures thereof.

Optional Co-surfactants

The liquid compositions of the present invention may further comprise a co-surfactant or a mixture thereof as an optional ingredient. Said co-surfactants may be present in the compositions according to the present invention in amounts of preferably from 0.1% to 50% by weight of the total composition, more preferably of from 0.1% to 40% and most preferably of from 1% to 30%.

Surfactants suitable for use herein as co-surfactants include additional anionic surfactants, nonionic surfactants, cationic surfactants, amphoteric surfactants, zwitterionic surfactants, and mixtures thereof.

Suitable anionic surfactants for use in the compositions herein include water-soluble salts or acids of the formula $ROSO_3M$ wherein R preferably is a $C_{10}$–$C_{24}$ hydrocarbyl, preferably linear or branched alkyl having a $C_{10}$–$C_{20}$ alkyl component, more preferably a $C_{12}$–$C_{18}$ linear or branched alkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like.

Other suitable additional anionic surfactants are alkyl propoxylated sulfates, preferably having from 0.5 to 30, more preferably 0.5 to 5 moles of propoxy groups.

Other anionic surfactants useful for detersive purposes can also be used herein. These can include salts (including, for example, sodium, potassium, ammonium, and substituted ammonium salts such as mono-, di-and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants for use herein also include acyl sarcosinate or mixtures thereof, in its acid and/or salt form, preferably long chain acyl sarcosinates having the following formula:

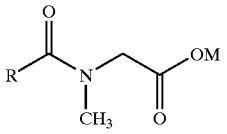

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Accordingly suitable nonionic synthetic surfactants include:

(i) The polyethylene oxide condensates of alkyl phenols, e.g., the condensation products of alkyl phenols having an alkyl group containing from 6 to 20 carbon atoms in either a straight chain or branched chain configuration, preferably from 8 to 12 carbon atoms, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane;

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000;

(iii) The condensation product of aliphatic alcohols having from 6 to 22 carbon atoms, in either straight chain or branched chain configuration, preferably from 8 to 18 carbon atoms, with from 2 to 35 moles of ethylene oxide, preferably from 4 to 25 and more preferably from 5 to 18. Example of this type of material are a coconut alcohol ethylene oxide condensate having from 5 to 18 moles of ethylene oxide per mole of coconut alcohol, the coconut alcohol fraction having from 9 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; specific example is tetradecyl dimethyl phosphine oxide;

(v) The condensation products of ethylene oxide with a hydrophobic base formed by the condensation of propylene oxide with propylene glycol; The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide.

Particularly suitable nonionic surfactants for use herein are capped nonionic ethoxylated surfactants according to the formula:

$$R_1(OR_2)_nOR_3$$

wherein $R_1$ is a $C_8$–$C_{18}$ linear or branched alkyl or alkenyl group, aryl group, alkaryl group, preferably, $R_1$ is a $C_{10}$–$C_{15}$ alkyl or alkenyl group, more preferably a $C_{10}$–$C_{15}$ alkyl group;

$R_2$ is a $C_2$–$C_{10}$ linear or branched alkyl group, preferably a $C_4$ group;

$R_3$ is a $C_1$–$C_{10}$ alkyl or alkenyl group, preferably a $C_1$–$C_5$ alkyl group, and n is an integer ranging in the range of from 1 to 20, preferably from 1 to 10, more preferably from 1 to 5;

or mixtures thereof.

These surfactants are commercially available from BASF under the trade name Plurafac®, from HOECHST under the trade name Genapol® or from ICI under the trade name Symperonic®. Preferred capped nonionic ethoxylated surfactant of the above formula are those commercially available under the tradename Genapol® L 2.5 NR from Hoechst, and Symperonic® LF/CS 1100 from ICI.

Other suitable nonionic surfactants for use herein include the amine oxides corresponding to the formula:

$$R\ R'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyldimethylamine oxide, N-decyldimethylamine oxide, N-dodecyl dimethylamine oxide, N-tetradecyldimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable nonionic surfactants for the purpose of the invention are the phosphine or sulfoxide surfactants of formula:

$$R\ R'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred zwitterionic detergent compounds have the formula:

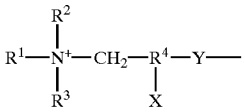

wherein R1 is an alkyl radical containing from 8 to 22 carbon atoms, R2 and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, R2 and R3 radicals is from 14 to 24 carbon atoms.

Amphoteric and ampholytic detergents which can be either cationic or anionic depending upon the pH of the system are represented by detergents such as dodecylbetaalanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon's Detergents and Emulsifiers, North American Ed. 1980, incorporated herein by reference.

Cationic surfactants suitable for use in compositions of the present invention are those having a long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH_2CH_2$—, and mixtures thereof; each $R^4$ is selected from the group consisting of $C_1$–$C_4$ alkyl, benzyl ring structures formed by joining the two $R^4$ groups, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Quaternary ammonium surfactant suitable for the present invention has the formula (I):

Formula I

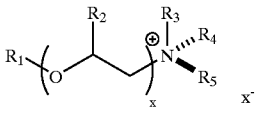

whereby R1 is a short chainlength alkyl (C6–C10)

y is 2–4, preferably 3 whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula II, whereby $X^-$ is a counterion, preferably a halide, e.g. chloride or methylsulfate.

Formula II

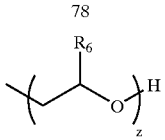

R6 is $C_1$–$C_4$ and z is 1 or 2.

Preferred quat ammonium surfactants are those as defined in formula I whereby $R_1$ is $C_8$, $C_{10}$ or mixtures thereof, x=o, $R_3$, $R_4$, $R_5$=$CH_3$.

Highly preferred cationic surfactants are the water-soluble quaternary ammonium compounds useful in the present composition having the formula $$R_1R_2R_3R_4N^+X^- \quad (i)$$

wherein $R_1$ is $C_8$–$C_{16}$ alkyl, each of $R_2$, $R_3$ and $R_4$ is independently $C_1$–$C_4$ alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and the anion X may be selected from halide, methosulphate, acetate and phosphate ions. Examples of suitable quaternary ammonium compounds of formulae (i) for use herein are:

coconut trimethyl ammonium chloride or bromide;

decyl triethyl ammonium chloride;

$C_{12-15}$ trimethyl ammonium chloride or bromide;

myristyl trimethyl ammonium methyl sulphate;

lauryl dimethyl benzyl ammonium chloride or bromide;

lauryl dimethyl $(ethenoxy)_4$ ammonium chloride or bromide;

choline esters (compounds of formula (i) wherein $R_1$ is

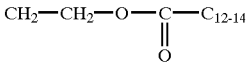

alkyl and $R_2R_3R_4$ are methyl).

di-alkyl imidazolines

Other cationic surfactants useful herein are also described in U.S. Pat. No. 4,228,044, Cambre, issued Oct. 14, 1980 and in European Patent Application EP 000,224.

Polymers

An optional component of the compositions herein is a polymer. That polymer, has surprisingly been found to also reduce the yellowing of the fabrics treated therewith, i.e. improve whiteness, as well as improve fabric safety. Naturally, for the purpose of the invention, the polymer has to be stable to the hypohalite bleach.

Suitable polymers for use are polymers comprising monomeric units selected from the group consisting of unsaturated carboxylic acids, polycarboxylic acids, sulphonic acids, phosphonic acids and mixtures thereof. Co-polymerisation of the above monomeric units among them or with other co-monomers such as styrenesulfonic acid is also suitable.

Preferred examples of such polymers are the polymers and co-polymers of monomeric units selected from the group consisting of acrylic acid, maleic acid, vinylsulphonic acid and mixtures thereof. Also suitable for use herein are the above mentioned polymers and co-polymers which are modified in order to contain other functional groups such as aminophosphonic and/or phosphonic units. More preferred polymers are selected from the group consisting of polyacrylate polymers, co-polymers of acrylic and maleic acid, co-polymers of styrene sulphonic acid and maleic acid, and mixtures thereof, preferably modified with aminophosphonic and/or phosphonic groups.

The molecular weight for these polymers and co-polymers is preferably below 100,000, most preferably between 500 and 50,000. Most suitable polymers and co-polymers for use herein will be soluble in an amount up to 0.1% by weight, in an aqueous composition comprising 5% by weight of sodium hypochlorite with its pH adjusted to 13 with sodium hydroxide.

Commercially available such polymers, suitable for use herein, are the polyacrylate polymers sold under the tradename Good-Rite® from BF Goodrich, Acrysol® from Rohm & Haas, Sokalan® from BASF, Norasol® from Norso Haas. Also suitable for use herein are the co-polymers of styrene sulphonic acid and maleic acid, commercially available under the tradename Versaflex® from National Starch such as Versaflex 157, as well as Acumer® terpolymers from Rohm and Haas, in particular Acumer® 3100. Preferred commercially available polymers are the polyacrylate polymers, especially the Norasol® polyacrylate polymers and more preferred are the polyacrylate polymer Norasol® 410N (MW 10,000) and the polyacrylate polymer modified with phosphonic groups Norasol® 440N (MW 4000) and its corresponding acid form Norasol® QR 784 (MW 4000).

A preferred polymer for use herein is a polyacrylate polymer modified with phosphonic groups commercially available under the tradename Norasol® 440N (MW 4000) and its corresponding acid form Norasol® QR 784 (MW 4000) from Norso-Haas.

Mixtures of polymers as herein described may also be used in the present invention.

Polymers herein are preferably present in low amounts, i.e. in amounts of up to 10%, preferably up to 1%, more preferably up to 0.5% by weight, even more preferably from 0.001% to 0.3% by weight, and most preferably from 0.005% to 0.2% by weight of the liquid composition.

Method of Bleaching Fabrics

Particularly preferred surfaces to be bleached with the compositions herein are fabrics including for example clothes, curtains, drapes, bed linens, bath linens, table cloths, sleeping bags, tents, upholstered furniture and the like, and carpets.

Thus, the present invention further encompasses a method of bleaching fabrics which comprises the step of contacting said fabrics with a bleaching composition according to the present invention. In a preferred embodiment, the compositions used in said method of bleaching fabrics are liquid hypochlorite-containing compositions that may further comprise a chelating agent and/or a pH buffering component as defined hereinbefore. Said method according to the present invention delivers effective whiteness performance upon ageing of the compositions.

The compositions according to the present invention are preferably contacted to fabrics in a liquid form. Indeed, by "in a liquid form", it is meant herein the liquid compositions according to the present invention per se in neat or diluted form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine. Said compositions can be diluted up to 500 times, preferably from 5 to 200 times and more preferably from 10 to 80 times.

More specifically, the method of bleaching fabrics according to the present invention comprises the steps of first contacting said fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted together with the bleaching of said fabrics by contacting said fabrics at the same time with a bleaching composition according to the present invention and said detergent composition, or said washing may be conducted before or after that said fabrics have been bleached. Accordingly, said method according to the present invention allows to bleach fabrics and optionally to wash fabrics with a detergent composition comprising at least one surface active agent before the step of contacting said fabrics with said bleaching composition and/or in the step where said fabrics are contacted with said bleaching composition and/or after the step where said fabrics are contacted with the bleaching composition and before the rinsing step and/or after the rinsing step.

In another embodiment of the present invention the method of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 30 minutes, preferably 1 minute to 10 minutes and then rinsing said fabrics with water. If said fabrics are to be washed, i.e., with a conventional composition comprising at least one surface active agent, said washing may be conducted before or after that said fabrics have been bleached. In the embodiment of the present invention wherein the liquid bleaching composition of the present invention, is contacted to the fabrics in its neat form, it is preferred that the level of hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach, despite a standing prejudice against using hypochlorite-containing compositions neat on fabrics.

It is preferred to perform the bleaching methods herein before said fabrics are washed. Indeed, it has been observed that bleaching said fabrics with the compositions according to the present invention (diluted and/or neat bleaching methods) prior to washing them with a detergent composition provides superior whiteness and stain removal with less energy and detergent than if said fabrics are washed first, then bleached.

Alternatively instead of following the neat bleaching method as described herein above (pretreater application) by a rinsing step with water and/or a conventional washing step with a liquid or powder conventional detergent, the bleaching pre-treatment operation may also be followed by the diluted bleaching method as described herein before either in bucket (hand operation) or in a washing machine.

EXAMPLE

The invention is illustrated in the following non-limiting examples, in which all percentages are on a weight basis unless otherwise stated.

| Composition (weight %) | I | II | III | IV |
|---|---|---|---|---|
| Sodium hypochlorite | 3.5 | 3.5 | 3.5 | 5.0 |
| Sodium hydroxide* | 1.25 | 1.25 | 1.25 | 1.0 |
| Sodium carbonate | 3.0 | 3.0 | 3.0 | 1.2 |
| Sodium silicate | 0.5 | 0.5 | 0.5 | 0.5 |
| Benzoic acid | 0.5 | — | 1.0 | 0.5 |
| Na C12–C14 E2S | 7.0 | 7.0 | 7.0 | 7.0 |
| Methoxy benzoate | 0.5 | 1.0 | — | 0.5 |
| Tinopal PLC ® | 0.01 | 0.01 | 0.01 | 0.01 |
| Sodium tripolyphosphate (STPP) | 0.1 | 0.1 | 0.1 | — |
| Water and minors | | up to 100% | | |

| Composition (weight %) | V | VI | VII | VIII |
|---|---|---|---|---|
| Sodium hypochlorite | 5.0 | 5.0 | 3.5 | 3.5 |
| Sodium hydroxide* | 1.0 | 1.0 | 1.25 | 1.25 |
| Sodium carbonate | 1.25 | 1.25 | 3.0 | 3.0 |
| Sodium silicate | 0.5 | 0.5 | 0.5 | 0.5 |
| Benzoic acid | — | 1.0 | — | — |
| Na C12–C14 E1S | 7.0 | 7.0 | 7.0 | 7.0 |
| Methoxy benzoate | 1.0 | — | 1.0 | 1.0 |
| Tinopal PLC ® | 0.01 | 0.01 | 0.01 | 0.01 |
| Phytic acid | — | — | — | 1.0 |
| Norasol 440N ® | — | — | 0.1 | 0.1 |
| Sodium tripolyphosphate (STPP) | 0.1 | 0.1 | — | — |
| Water and minors | | up to 100% | | |

| Composition (weight %) | IX | X | XI | XII |
|---|---|---|---|---|
| Sodium hypochlorite | 3.6 | 3.5 | 3.5 | 3.5 |
| Sodium hydroxide* | 1.25 | 1.25 | 1.25 | 1.25 |
| Sodium carbonate | 3.0 | 3.0 | 3.0 | 3.0 |
| Sodium silicate | 0.5 | 0.50 | 0.50 | 0.5 |
| Benzoic acid | 3.0 | — | — | — |
| Na C12–C14 E0.5S | 7.0 | 7.0 | 7.0 | 7.0 |
| Sodium borate | — | — | 3.0 | 3.0 |
| Methoxy benzoate | — | 1.0 | 1.0 | 1.0 |
| Tinopal PLC ® | — | — | — | 0.01 |
| Optiblanc BRB ® | 0.01 | 0.01 | 0.01 | — |
| Sodium tripolyphosphate (STPP) | — | 0.1 | — | 0.1 |
| Water and minors | | up to 100% | | |

*added NaOH
Tinopal PLC ® is bis(sulfobenzenfuranyl)biphenyl available from Ciba Geigy.
Optiblanc ® is a stilbene derivative brightener available from 3 V Sigma.
Na C12–C14 E0.5,1,2S are alkyl (ethoxy) 0.5,1,2 sulphate commercially available from Rhone Poulenc and Albright & Wilson.
Benzoic acid is commercially available from Elf Atochem, Enichem, or Albright & Wilson.
Methoxy benzoate is commercially available from Aldrich.
Norasol 440N ® is a polyacrylate polymer modified with phosphonic groups (MW 4000) from Norso Haas.

The compositions exemplified above exhibit effective whiteness performance when used to bleach fabrics both in neat or diluted conditions (e.g. at a dilution of 200 (typical dilution)) after 3 months of storage at room temperature (e.g. about 25° C.) after their manufacturing.

What is claimed is:

1. A liquid bleaching composition comprising from 0.01% to 1% of a hypohalite bleach and an alkyl ethoxy sulphate surfactant having an average of 2 or less moles of ethoxy groups and up to 50% by weight of a surfactant having the following formula:

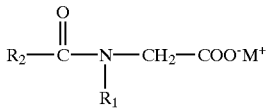

wherein $R_1$ is a linear or branched chain lower alkyl of from 1 to 4 carbon atoms; $R_2$ represents a hydrocarbon chain; and M is an alkali metal.

2. A liquid bleaching composition according to claim 1 comprising 0% by weight of a surfactant having the following formula:

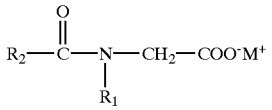

wherein $R_1$ is a linear or branched chain lower alkyl of from 1 to 4 carbon atoms; $R_2$ represents a hydrocarbon chain; and M is an alkali metal.

3. A process of bleaching fabrics which comprises the steps of contacting a fabric or portion thereof with the composition of claim 1, in its neat or diluted form, before rinsing said fabrics or washing then rinsing said fabrics.

4. A liquid bleaching composition comprising from 0.01% to 1% of a hypohalite bleach and an alkyl ethoxy sulphate surfactant having an average of 2 or less moles of ethoxy groups and up to 50% by weight of a surfactant having the following formula:

$$R_3SO_4^-M^+$$

wherein $R_3$ represents a linear or branched alkyl group of from about 8 to about 18 carbon atoms; and M is an alkali metal.

5. A liquid bleaching composition according to claim 4 comprising 0% by weight of a surfactant having the following formula:

$$R_3SO_4^-M^+$$

wherein $R_3$ represents a linear or branched alkyl group of from about 8 to about 18 carbon atoms; and M is an alkali metal.

6. A process of bleaching fabrics which comprises the steps of contacting a fabric or portion thereof with the composition of claim 4, in its neat or diluted form, before rinsing said fabrics or washing then rinsing said fabrics.

* * * * *